US012736056B2

(12) United States Patent
Saito et al.

(10) Patent No.: US 12,736,056 B2
(45) Date of Patent: Sep. 15, 2026

(54) ELECTRIC TURBO COMPRESSOR

(71) Applicant: KABUSHIKI KAISHA TOYOTA JIDOSHOKKI, Kariya (JP)

(72) Inventors: Hiroshi Saito, Kariya (JP); Yuki Okano, Kariya (JP); Yuki Endo, Kariya (JP); Arata Ioki, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 7 days.

(21) Appl. No.: 18/691,285

(22) PCT Filed: Mar. 15, 2022

(86) PCT No.: PCT/JP2022/011619

§ 371 (c)(1),
(2) Date: Mar. 12, 2024

(87) PCT Pub. No.: WO2023/042441

PCT Pub. Date: Mar. 23, 2023

(65) Prior Publication Data

US 2024/0392792 A1 Nov. 28, 2024

(30) Foreign Application Priority Data

Sep. 16, 2021 (JP) ..... 2021-151033

(51) Int. Cl.
*F04D 17/12* (2006.01)
*F04D 25/06* (2006.01)
*F04D 29/42* (2006.01)

(52) U.S. Cl.
CPC ..... *F04D 17/122* (2013.01); *F04D 25/06* (2013.01); *F04D 29/4206* (2013.01)

(58) Field of Classification Search
CPC .... F04D 25/06; F04D 29/4206; F04D 29/286; F04D 29/30; F04D 29/441
See application file for complete search history.

(56) References Cited

U.S. PATENT DOCUMENTS

2015/0267707 A1 9/2015 Hoshino et al.
2015/0267717 A1* 9/2015 Fujii ..... F04D 29/057 415/220

(Continued)

FOREIGN PATENT DOCUMENTS

JP 2015-194151 A 11/2015

OTHER PUBLICATIONS

International Search Report for PCT/JP2022/011619 dated May 10, 2022.

(Continued)

*Primary Examiner* — David N Brandt
(74) *Attorney, Agent, or Firm* — Sughrue Mion, PLLC

(57) ABSTRACT

An electric turbo compressor includes a first impeller includes a first hub fixed to the rotary shaft, and a plurality of first blades arranged on the first hub, a second impeller includes a second hub fixed to the rotary shaft, and a plurality of second blades arranged on the second hub. A housing includes a first shroud facing the first blades and forming a first impeller chamber that accommodates the first impeller, and a second shroud facing the second blades and forming a second impeller chamber that accommodates the second impeller. A first trailing end gap that is a gap between the trailing end of each of the first blades and the first shroud is smaller than a second trailing end gap that is a gap between the trailing end of each of the second blades and the second shroud.

5 Claims, 4 Drawing Sheets

(56) References Cited

U.S. PATENT DOCUMENTS

| | | | | |
|---|---|---|---|---|
| 2016/0177961 | A1* | 6/2016 | Ogata | F04D 29/047<br>416/198 A |
| 2019/0055954 | A1* | 2/2019 | Egawa | F04D 29/057 |
| 2020/0011334 | A1* | 1/2020 | Martignago | F04D 29/162 |

OTHER PUBLICATIONS

Office Action issued Oct. 22, 2025 in Korean Patent Application No. 10-2024-7007254.

* cited by examiner

ELECTRIC TURBO COMPRESSOR

CROSS-REFERENCE TO RELATED APPLICATIONS

This application is a National Stage of International Application No. PCT/JP2022/011619 filed Mar. 15, 2022, claiming priority based on Japanese Patent Application No. 2021-151033 filed Sep. 16, 2021, the contents of all of which are incorporated herein by reference in their entirety.

TECHNICAL FIELD

The present disclosure relates to an electric turbo compressor.

BACKGROUND ART

A conventional electric turbo compressor is disclosed in the Japanese Patent Application Publication No. 2015-194151 (Patent Document 1), for example. The electric turbo compressor has a rotary shaft that is driven to rotate, and a first impeller and a second impeller that are mounted on the rotary shaft.

CITATION LIST

Patent Document

Patent Document 1: Japanese Patent Application Publication No. 2015-194151

SUMMARY OF INVENTION

Technical Problem

The present disclosure proposes an electric turbo compressor that can perform efficient two-stage compression.

Solution to Problem

According to the conventional knowledge, an efficiency of a compressor is determined by the relationship between a height of a blade of an impeller at an outlet and a tip clearance, and if the height of the blade at the outlet is small, the efficiency deteriorates unless the tip clearance is also made small. As a result of an intensive study on improvement of the efficiency of a turbo compressor that performs two-stage compression, the present inventors have found that an effect of the tip clearance differs from the above-mentioned conventional knowledge, and have devised the following configuration.

In accordance with the present disclosure, an electric turbo compressor including a housing, an electric motor accommodated in the housing, a rotary shaft accommodated in the housing and driven to rotate by the electric motor, and a first impeller and a second impeller rotating together with the rotary shaft is proposed. The electric motor, the first impeller, the second impeller are arranged in this order in an axial direction of the rotary shaft. The first impeller includes a first hub fixed to the rotary shaft, and a plurality of first blades arranged in the first hub. The second impeller includes a second hub fixed to the rotary shaft, and a plurality of second blades arranged in the second hub. The first impeller moves gas from a leading end to a trailing end of each of the first blades with rotation. The second impeller moves the gas moved by the first impeller from a leading end to a trailing end of each of the second blades with rotation. A housing includes a first shroud facing the first blades and forming a first impeller chamber that accommodates the first impeller, and a second shroud facing the second blades and forming a second impeller chamber that accommodates the second impeller. A gap between the trailing end of each of the first blades and the first shroud is a first trailing end gap that has a shortest distance between each of the first blades and the first shroud, and a gap between the trailing end of each of the second blades and the second shroud is a second trailing end gap that has a shortest distance between each of the second blades and the first shroud, and the first trailing end gap is smaller than the second trailing end gap.

By setting the gaps in this manner, disturbance in the flow of refrigerant in the first impeller may be suppressed, which allows the electric turbo compressor to perform efficient two-stage compression. Furthermore, since contact between the second impeller and the housing may be suppressed, the reliability of the electric turbo compressor may be improved.

In the above-described electric turbo compressor, a height of the trailing end of each of the first blades toward the first trailing end gap is a first outlet height, and a height of the trailing end of each of the second blades toward the second trailing end gap is a second outlet height, and the first outlet height may be the higher than the second outlet height. Increasing the pressure of the refrigerant discharged from the first impeller by improving the compression efficiency of the first impeller allows the flow velocity of the refrigerant flowing into the second impeller to be reduced. As a result, an effect of making the first trailing end gap smaller than the second trailing end gap to achieve the efficient two-stage compression may be more reliably obtained.

In the above-described electric turbo compressor, an outer diameter of the first impeller may be greater than an outer diameter of the second impeller. Increasing the pressure of the refrigerant discharged from the first impeller by improving the compression efficiency of the first impeller allows the flow velocity of the refrigerant flowing into the second impeller to be reduced. As a result, an effect of making the first trailing end gap smaller than the second trailing end gap to achieve the efficient two-stage compression may be more reliably obtained.

In the above-described electric turbo compressor, a gap between the leading end of each of the first blades and the first shroud is a first leading end gap that has a shortest distance between each of the first blades and the first shroud, and a gap between the leading end of each of the second blades and the second shroud is a second leading end gap that has a shortest distance between each of the second blades and the second shroud, and the first leading end gap may be smaller than the second leading end gap. By setting the gaps in this manner, disturbance in the flow of refrigerant may be suppressed, which allows the electric turbo compressor to perform the efficient two-stage compression. Furthermore, since contact between the second impeller and the housing may be suppressed, the reliability may be improved.

The above-described electric turbo compressor may be configured to compress refrigerant circulating in a refrigeration cycle. As a result, efficient and reliable two-stage compression may be achieved by making the first trailing end gap smaller than the second trailing end gap.

Effect of Invention

According to the electric turbo compressor of the present disclosure, efficient two-stage compression may be performed.

DESCRIPTION OF EMBODIMENTS

Figure 1:
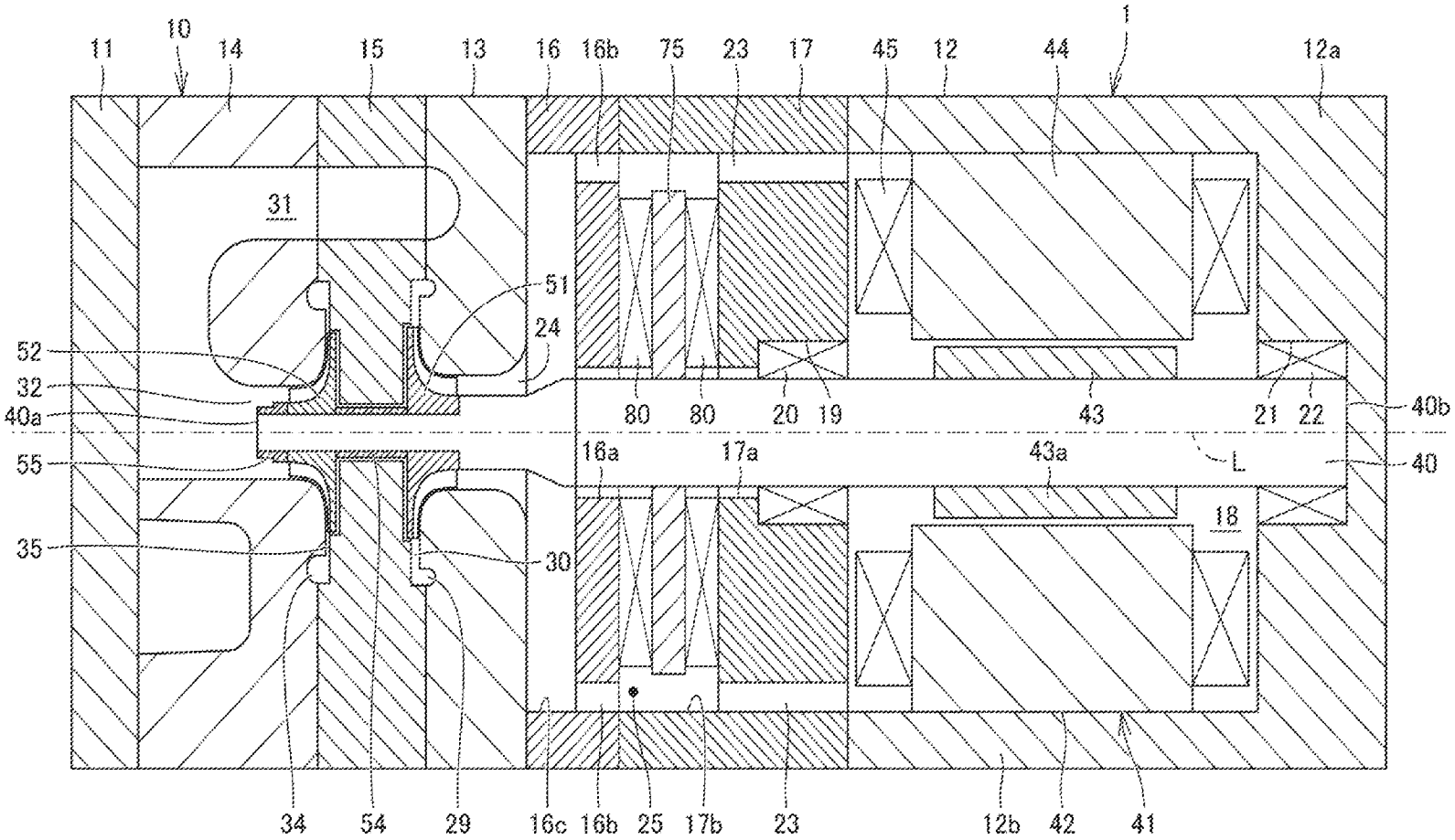
FIG. 1 is a cross-sectional side view of an electric turbo compressor according to an embodiment.

Hereinafter, an embodiment will be described with reference to the drawings. In the following description, identical parts are designated with the same reference numerals and characters. Names and functions for these parts are the same. Therefore, the detailed descriptions thereof will not be repeated.

An electric turbo compressor of the embodiment is used, for example, for an air conditioner. Fluid to be compressed by the electric turbo compressor is refrigerant circulating in a refrigeration cycle. FIG. 1 is a cross-sectional side view of an electric turbo compressor 1 according to the embodiment.

As illustrated in FIG. 1, the electric turbo compressor 1 includes a housing 10 having a tubular shape. The housing 10 has a rear housing 11, a motor housing 12, a first compressor housing 13, a second compressor housing 14, a partition wall 15, a first intermediate housing 16, and a second intermediate housing 17. The rear housing 11, the motor housing 12, the first compressor housing 13, the second compressor housing 14, the partition wall 15, the first intermediate housing 16, and the second intermediate housing 17 are each made of metal material, for example, aluminum.

The motor housing 12 has a bottomed tubular shape, and includes an end wall 12*a* having a plate shape and a peripheral wall 12*b* extending in a tubular shape from an outer periphery of the end wall 12*a*. The second intermediate housing 17 is connected to the motor housing 12 with an opening of the peripheral wall 12*b* opposite from the end wall 12*a* closed by the second intermediate housing 17. A motor chamber 18 is defined by the end wall 12*a*, the peripheral wall 12*b* of the motor housing 12, and the second intermediate housing 17. The motor housing 12 has an inlet hole (not illustrated) through which refrigerant is introduced. The inlet hole is in communication with the motor chamber 18. Thus, refrigerant is introduced into the motor chamber 18 through the inlet hole.

A shaft insertion hole 17*a* having a circular hole shape is formed in a central portion of the second intermediate housing 17. The second intermediate housing 17 has a first bearing holder 19 having a cylindrical shape. The first bearing holder 19 is formed on an inner peripheral surface of the second intermediate housing 17. An inside of the first bearing holder 19 is in communication with the shaft insertion hole 17*a*. A central axis of the first bearing holder 19 and a central axis of the shaft insertion hole 17*a* coincide with each other. A first radial bearing 20 is held by the first bearing holder 19.

The end wall 12*a* of the motor housing 12 has a second bearing holder 21 having a cylindrical shape. The second bearing holder 21 is formed in a central portion of the end wall 12*a* of the motor housing 12. The central axis of the first bearing holder 19 coincides with a central axis of the second bearing holder 21. A second radial bearing 22 is held by the second bearing holder 21. The first radial bearing 20 and the second radial bearing 22 are disposed in the housing 10.

A first chamber forming recess 17*b* is formed in an outer surface of the second intermediate housing 17 opposite from the motor chamber 18. The first chamber forming recess 17*b* is in communication with the shaft insertion hole 17*a*. The second intermediate housing 17 has a plurality of communication holes 23. The communication holes 23 are positioned in a portion of the second intermediate housing 17 close to an outer periphery thereof. The communication holes 23 extend through the second intermediate housing 17. The communication holes 23 provide communication between the motor chamber 18 and the first chamber forming recess 17*b*.

The first intermediate housing 16 is connected to the second intermediate housing 17. The first intermediate housing 16 is connected to the second intermediate housing 17 so that an opening of the first chamber forming recess 17*b* is closed by the first intermediate housing 16. A thrust bearing accommodation chamber 25 is defined by the first intermediate housing 16 and the first chamber forming recess 17*b* of the second intermediate housing 17. A shaft insertion hole 16*a* having a circular hole shape is formed in a central portion of the first intermediate housing 16.

The first intermediate housing 16 has a plurality of communication holes 16*b*. The communication holes 16*b* are positioned in a portion of the first intermediate housing 16 close to an outer periphery thereof. The communication holes 16*b* extend through the first intermediate housing 16. A second chamber forming recess 16*c* is formed in an outer surface of the first intermediate housing 16 opposite from the thrust bearing accommodation chamber 25. The second chamber forming recess 16*c* is in communication with the shaft insertion hole 16*a*. The communication holes 16*b* provide communication between the thrust bearing accommodation chamber 25 and the second chamber forming recess 16*c*.

The first compressor housing 13 has a tubular shape and has a first inlet 24 having a circular hole shape. The first compressor housing 13 is connected to the first intermediate housing 16 in a state in which a central axis of the first inlet 24 coincide with a central axis of the shaft insertion hole 16*a*. The first inlet 24 is in communication with the second chamber forming recess 16*c*.

The partition wall 15 is connected to an end surface of the first compressor housing 13 opposite from the first intermediate housing 16. The partition wall 15 has a plate shape. A through hole 27 (FIG. 2) having a circular hole shape is formed in a central portion of the partition wall 15. The through hole 27 extends through the partition wall 15 in a thickness direction of the partition wall 15. The partition wall 15 is connected to the first compressor housing 13 in a state in which a central axis of the through hole 27 coincides with the central axis of the first inlet 24.

Figure 2:
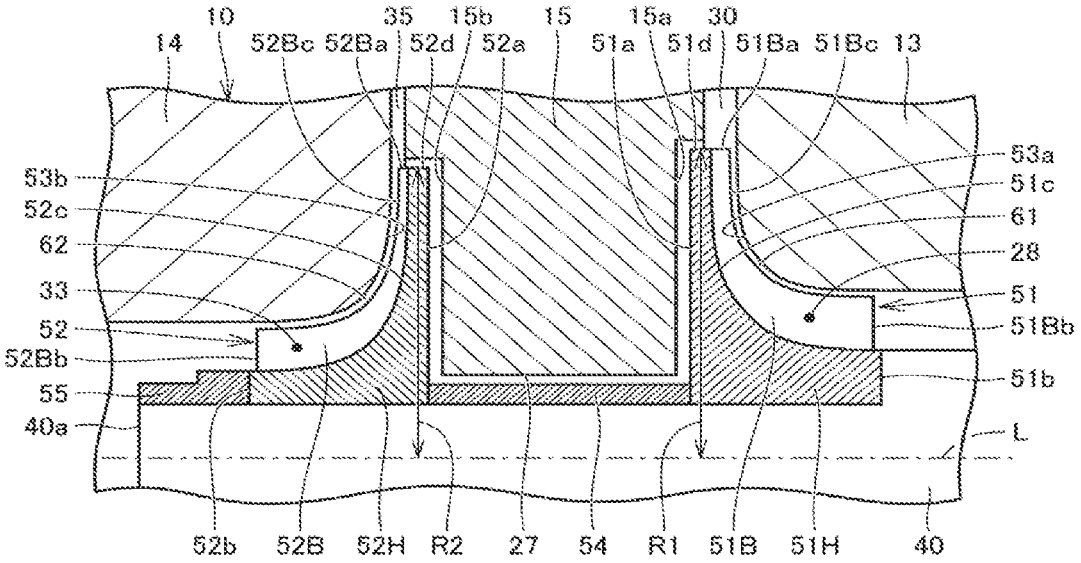
FIG. 2 is an enlarged cross-sectional view illustrating a vicinity of impellers.

FIG. 2 is an enlarged cross-sectional view illustrating a vicinity of impellers. As illustrated in FIGS. 1 and 2, a first impeller chamber 28 in communication with the first inlet 24, a first discharge chamber 29 extending around the central axis of the first inlet 24 around the first impeller chamber 28, a first diffuser passage 30 providing communication between the first impeller chamber 28, and the first discharge chamber 29 are formed between the partition wall 15 and the first compressor housing 13.

The second compressor housing 14 is connected to an end surface of the partition wall 15 opposite from the first compressor housing 13. An intermediate pressure chamber 31 is formed across the first compressor housing 13, the partition wall 15, and the second compressor housing 14. The intermediate pressure chamber 31 is in communication with the first discharge chamber 29 through a passage (not illustrated). The second compressor housing 14 has a second inlet 32 having a circular hole shape and in communication with the intermediate pressure chamber 31. The first discharge chamber 29 and the second inlet 32 are in communication with each other through the intermediate pressure chamber 31.

A second impeller chamber 33 in communication with the second inlet 32, a second discharge chamber 34 extending around the central axis of the second inlet 32 around the second impeller chamber 33, and a second diffuser passage 35 providing communication between the second impeller chamber 33 and the second discharge chamber 34 are formed between the partition wall 15 and the second compressor housing 14.

The housing 10 has the first impeller chamber 28 and the second impeller chamber 33. The first impeller chamber 28 and the second impeller chamber 33 are partitioned by the partition wall 15.

The rear housing 11 is connected to the second compressor housing 14. The rear housing 11 defines the intermediate pressure chamber 31. The rear housing 11 has a plate shape.

The electric turbo compressor 1 includes a rotary shaft 40. The rotary shaft 40 extends from an inside of the second bearing holder 21 and passes through the motor chamber 18, an inside of the first bearing holder 19, the shaft insertion hole 17*a*, the thrust bearing accommodation chamber 25, the shaft insertion hole 16*a*, the first inlet 24, the first impeller chamber 28, the through hole 27, the second impeller chamber 33, and the second inlet 32 in this order in an axial direction of the housing 10. The rotary shaft 40 is disposed across the first impeller chamber 28 and the second impeller chamber 33 with the rotary shaft 40 inserted through the through hole 27.

The rotary shaft 40 has a first end 40*a* and a second end 40*b* on one end and the other end, respectively, of the rotary shaft 40. The first end 40*a* is positioned in the second compressor housing 14. The second end 40*b* is positioned in the end wall 12*a* of the motor housing 12. The rotary shaft 40 is accommodated in the housing 10.

The rotary shaft 40 has an axis L that coincides with the central axes of the first bearing holder 19, the second bearing holder 21, the shaft insertion hole 17*a*, the shaft insertion hole 16*a*, the first inlet 24, the through hole 27, and the second inlet 32. In the following description, the "axial direction of the rotary shaft 40," which is a direction in which the axis L of the rotary shaft 40 extends, may be referred to as a "thrust direction" and a "radial direction of the rotary shaft 40" as a "radial direction.

The first radial bearing 20 and the second radial bearing 22 rotatably support the rotary shaft 40 in the radial direction. The first radial bearing 20 and the second radial bearing 22 each may be an aerodynamic bearing.

The electric turbo compressor 1 has a support plate 75 having a disk shape and formed on the rotary shaft 40. The support plate 75 protrudes radially outward from an outer peripheral surface of the rotary shaft 40. The support plate 75 rotates together with the rotary shaft 40. The support plate 75 is disposed in the thrust bearing accommodation chamber 25.

Thrust bearings 80 are disposed between the first intermediate housing 16 and the support plate 75, and between the second intermediate housing 17 and the support plate 75, respectively. Both of the thrust bearings 80 rotatably support the rotary shaft 40 in the thrust direction. The thrust bearings 80 each may be an aerodynamic bearing.

The electric turbo compressor 1 includes an electric motor 41. The electric motor 41 is accommodated in the motor chamber 18. The electric motor 41 is accommodated in the housing 10. The electric motor 41 is an example of a drive power source that drives the rotary shaft 40 to rotate. The electric motor 41 includes a stator 42 and a rotor 43.

The stator 42 includes a stator core 44 having a cylindrical shape, and a coil 45 wound around the stator core 44. The stator core 44 is fixed to the inner peripheral surface of the peripheral wall 12*b* of the motor housing 12.

The rotor 43 is positioned inside the stator core 44 in the radial direction in the motor chamber 18. The rotor 43 rotates together with the rotary shaft 40. The rotor 43 includes a rotor core 43*a* fixed to the rotary shaft 40, and a plurality of permanent magnets (not illustrated) disposed in the rotor core 43*a*. Electric power controlled by an inverter device (not illustrated) is supplied to the coil 45, which rotates the rotor 43 of the electric motor 41. The rotary shaft 40 rotates together with the rotor 43.

The electric turbo compressor 1 includes a first impeller 51 and a second impeller 52. The first impeller 51 and the second impeller 52 are made of aluminum, for example. The first impeller 51 and the second impeller 52 are connected to the rotary shaft 40. The first impeller 51 and the second impeller 52 rotate together with the rotary shaft 40.

The second impeller 52 is disposed closer to the first end 40*a* of the rotary shaft 40 than the first impeller 51 is. The first impeller 51 and the second impeller 52 are disposed closer to the first end 40*a* of the rotary shaft 40 than the first radial bearing 20 is. The first impeller 51 is disposed closer to the electric motor 41 than the second impeller 52 is. The electric motor 41, the first impeller 51, and the second impeller 52 are arranged in this order in the axial direction of the rotary shaft 40. As illustrated in FIG. 2, the first impeller 51 is accommodated in the first impeller chamber 28. The second impeller 52 is accommodated in the second impeller chamber 33.

The first impeller 51 includes a first hub 51H. The first hub 51H is fixed to the rotary shaft 40. The first hub 51H has a trailing end surface 51*a*, a leading end surface 51*b*, an outer peripheral surface 51*c*, and a radial outer edge portion 51*d*. The trailing end surface 51*a*, the leading end surface 51*b*, the outer peripheral surface 51*c*, and the radial outer edge portion 51*d* form part of an outer surface of the first hub 51H. The first hub 51H has a substantially truncated conical shape, the outer diameter of which increases from the leading end surface 51*b* positioned on the first inlet 24 side toward the trailing end surface 51*a*.

The trailing end surface 51*a* forms a rear end of the first hub 51H. The trailing end surface 51*a* forms part of the outer surface of the first hub 51H that does not form a refrigerant flow passage. In a state in which the first impeller 51 is connected to the rotary shaft 40 and the electric turbo compressor 1 is assembled, the trailing end surface 51*a* faces the partition wall 15 in the axial direction of the rotary shaft 40. The partition wall 15 has a first facing surface 15*a* that faces the trailing end surface 51*a* of the first hub 51H in the axial direction of the rotary shaft 40.

The leading end surface 51*b* forms a front end of the first hub 51H. The leading end surface 51*b* forms one end of the first impeller 51 in the axial direction of the rotary shaft 40. The leading end surface 51*b* corresponds to an end of the first hub 51H on a side on which refrigerant flows into the first impeller 51.

The outer peripheral surface (hub surface) 51*c* forms part of an inner wall surface of the first impeller chamber 28. The outer peripheral surface 51*c* is a curved surface concaved toward the axis L of the rotary shaft 40. At least a portion of the outer peripheral surface 51*c* faces outward in the radial direction of the rotary shaft 40. The outer peripheral surface 51*c* is formed so that the diameter of the outer peripheral surface 51*c* gradually increases from the leading end surface 51*b* to the trailing end surface 51*a* along the axial direction of the rotary shaft 40. The outer peripheral surface 51*c* is gradually inclined outward in the radial direction from the leading end surface 51*b* to the trailing end surface 51*a*.

The radial outer edge portion 51*d* is a portion of the first impeller 51 having the largest outer diameter. The radial outer edge portion 51*d* has a cylindrical shape with a short axis. The first impeller 51 has an outer diameter R1. The outer diameter R1 of the first impeller 51 is a distance between the axis L of the rotary shaft 40 and the radial outer edge portion 51*d* of the first impeller 51 in the radial direction of the rotary shaft 40.

The first impeller 51 has a plurality of first blades 51B. The plurality of first blades 51B are provided on the outer peripheral surface 51*c* of the first hub 51H. The plurality of first blades 51B are arranged in a circumferential direction of the first hub 51H. The plurality of first blades 51B divide the first impeller chamber 28 in the circumferential direction to form refrigerant flow passages between pairs of the first blades 51B disposed side by side in the circumferential direction. The first blades 51B project radially outward from the outer peripheral surface 51*c* of the first hub 51H. The plurality of first blades 51B are arranged at equal intervals in the circumferential direction on the outer peripheral surface 51*c* of the first hub 51H. The distance between the first blades 51B disposed side by side in the circumferential direction of the first hub 51H increases from the front end to the rear end of the first hub 51H.

The first blades 51B each have a trailing end 51Ba, a leading end 51Bb, and an edge surface 51Bc. The trailing end 51Ba, the leading end 51Bb, and the edge surface 51Bc form part of the edge portion of each of the first blades 51B. The leading end 51Bb of each of the first blades 51B faces the first inlet 24. The trailing end 51Ba of each of the first blades 51B faces the first diffuser passage 30. The edge surface 51Bc of each of the first blades 51B faces the first compressor housing 13. The leading end 51Bb extends in the radial direction of the rotary shaft 40. The trailing end 51Ba extends in the axial direction of the rotary shaft 40.

The edge surface 51Bc is curved. The edge surface 51Bc is formed so that the diameter of the edge surface 51Bc gradually increases from the leading end 51Bb to the trailing end 51Ba along the axial direction of the rotary shaft 40. The edge surface 51Bc is gradually inclined outward in the radial direction from the leading end 51Bb to the trailing end 51Ba. The curvature of the edge surface 51Bc of each of the first blades 51B is larger than the curvature of the outer peripheral surface 51*c* of the first hub 51H.

The leading end 51Bb is an edge portion of each of the first blades 51B on an upstream side in a refrigerant flow direction. Refrigerant from the first inlet 24 flows into spaces between the pairs of the first blades 51B disposed side by side in the circumferential direction, via spaces between the leading ends 51Bb. The trailing end 51Ba is an edge portion of each of the first blades 51B on a downstream side in the refrigerant flow direction. The refrigerant flows radially outward via the spaces between pairs of the trailing ends 51Ba disposed side by side in the circumferential direction.

The second impeller 52 has a second hub 52H. The second hub 52H is fixed to the rotary shaft 40. The second hub 52H has a trailing end surface 52*a*, a leading end surface 52*b*, an outer peripheral surface 52*c*, and a radial outer edge portion 52*d*. The trailing end surface 52*a*, the leading end surface 52*b*, the outer peripheral surface 52*c*, and the radial outer edge portion 52*d* form part of an outer surface of the second hub 52H. The second hub 52H has a substantially conical shape, the outer diameter of which increases from the leading end surface 52*b* positioned on the second inlet 32 side toward the trailing end surface 52*a*.

The trailing end surface 52*a* forms a rear end of the second hub 52H. The trailing end surface 52*a* forms part of the outer surface of the second hub 52H that does not form the refrigerant flow passage. In a state in which the second impeller 52 is connected to the rotary shaft 40 and the electric turbo compressor 1 is assembled, the trailing end surface 52*a* faces the partition wall 15 in the axial direction of the rotary shaft 40. The partition wall 15 has a second facing surface 15*b* that faces the trailing end surface 52*a* of the second hub 52H in the axial direction of the rotary shaft 40.

The leading end surface 52*b* forms a front end of the second hub 52H. The leading end surface 52*b* forms one end of the second impeller 52 in the axial direction of the rotary shaft 40. The leading end surface 52*b* corresponds to an end of the second hub 52H on a side on which refrigerant flows into the second impeller 52.

The outer peripheral surface (hub surface) 52*c* forms part of an inner wall surface of the second impeller chamber 33. The outer peripheral surface 52*c* is a curved surface concaved toward the axis L of the rotary shaft 40. At least a portion of the outer peripheral surface 52*c* faces outward in the radial direction of the rotary shaft 40. The outer peripheral surface 52*c* is formed so that the diameter of the outer peripheral surface 52*c* gradually increases from the leading end surface 52*b* to the trailing end surface 52*a* along the axial direction of the rotary shaft 40. The outer peripheral surface 52*c* is gradually inclined outward in the radial direction from the leading end surface 52*b* toward the trailing end surface 52*a*.

The radial outer edge portion 52*d* is a portion of the second impeller 52 having the largest outer diameter. The radial outer edge portion 52*d* has a cylindrical shape with a short axis. The second impeller 52 has an outer diameter R2. The outer diameter R2 of the second impeller 52 corresponds to a distance between the axis L of the rotary shaft 40 and the radial outer edge portion 52*d* of the second impeller 52 in the radial direction of the rotary shaft 40. As illustrated in FIG. 2, the outer diameter R1 of the first impeller 51 is greater than the outer diameter R2 of the second impeller 52.

The second impeller 52 has a plurality of second blades 52B. The plurality of second blades 52B are provided on the outer peripheral surface 52*c* of the second hub 52H. The plurality of second blades 52B are arranged in a circumferential direction of the second hub 52H. The plurality of second blades 52B divide the second impeller chamber 33 in the circumferential direction to form refrigerant flow passages between pairs of the second blades 52B disposed side by side in the circumferential direction. The second blades 52B project radially outward from the outer peripheral surface 52*c* of the second hub 52H. The plurality of second blades 52B are arranged at equal intervals in the circumferential direction in the outer peripheral surface 52*c* of the second hub 52H. A distance between the second blades 52B disposed side by side in the circumferential direction of the second hub 52H gradually increases from the front end to the rear end of the second hub 52H.

The second blades 52B each have a trailing end 52Ba, a leading end 52Bb, and an edge surface 52Bc. The trailing end 52Ba, the leading end 52Bb, and the edge surface 52Bc form part of an edge portion of each of the second blades 52B. The leading end 52Bb of each of the second blades 52B faces the second inlet 32. The trailing end 52Ba of each of the second blades 52B faces the second diffuser passage 35. The edge surface 52Bc of each of the second blades 52B faces the second compressor housing 14. The leading end 52Bb extends in the radial direction of the rotary shaft 40. The trailing end 52Ba extends in the axial direction of the rotary shaft 40.

The edge surface 52Bc is curved. The edge surface 52Bc is formed so that the diameter of the edge surface 52Bc gradually increases from the leading end 52Bb to the trailing end 52Ba along the axial direction of the rotary shaft 40. The edge surface 52Bc is gradually inclined outward in the radial direction from the leading end 52Bb toward the trailing end 52Ba. The curvature of the edge surface 52Bc of each of the second blades 52B is larger than the curvature of the outer peripheral surface 52*c* of the second hub 52H.

The leading end 52Bb is an edge portion of each of the second blades 52B on an upstream side in a refrigerant flow direction. Refrigerant from the second inlet 32 flows into spaces between the pairs of the second blades 52B disposed side by side in the circumferential direction, via spaces between the leading ends 52Bb. The trailing end 52Ba is an edge portion of each of the second blades 52B on a downstream side in the refrigerant flow direction. The refrigerant flows radially outward through spaces between pairs of the trailing ends 52Ba disposed side by side in the circumferential direction.

The electric motor 41 drives a rotating body including the rotary shaft 40, the first impeller 51, and the second impeller 52 to rotate, so that the rotating body rotates integrally around the axis L. The first impeller 51 rotates together with the rotary shaft 40 to move gaseous refrigerant from the leading ends 51Bb to the trailing ends 51Ba of the first blades 51B and compress the refrigerant. The second impeller 52 rotates together with the rotary shaft 40 to move the gaseous refrigerant moved and compressed by the first impeller 51 from the leading end 52Bb to the trailing end 52Ba of the second blades 52B and t compress the refrigerant. The first impeller 51 is disposed upstream, and the second impeller 52 is disposed downstream in the refrigerant flow direction.

The first impeller 51 and the second impeller 52 are disposed on the rotary shaft 40 so that the trailing end surface 51*a* of the first hub 51H and the trailing end surface 52*a* of the second hub 52H face each other across the partition wall 15. A spacer 54 having a hollow cylindrical shape is disposed between the first impeller 51 and the second impeller 52. The spacer 54 has a first end facing the trailing end surface 51*a* of the first hub 51H and a second end facing the trailing end surface 52*a* of the second hub 52H. A dimension of the spacer 54 in the axial direction of the rotary shaft 40 is slightly greater than a distance between the first facing surface 15*a* and the second facing surface 15*b* of the partition wall 15. The spacer 54 functions to seal a gap between the outer peripheral surface of the rotary shaft 40 and the inner peripheral surface of the through hole 27.

The rotary shaft 40 has a fitting member 55 mounted to the outer peripheral surface of the rotary shaft 40 in the first end 40*a*. The fitting member 55 has a hollow tubular shape. The fitting member 55 is mounted to the rotary shaft 40 by way of screwing, for example. The fitting member 55 is in contact with the leading end surface 52*b* of the second hub 52H. The fitting member 55 supports the second impeller 52 in the axial direction of the rotary shaft 40.

The first compressor housing 13 has a first shroud 53*a* that cooperates with the partition wall 15 to define the first impeller chamber 28. The first shroud 53*a* has a truncated conical shape, which covers the first impeller 51 from an outer side in the radial direction. The first shroud 53*a* faces the outer peripheral surface 51*c* of the first hub 51H. The first shroud 53*a* extends along the outer peripheral surface 51*c* of the first hub 51H from the trailing end surface 51*a* to the leading end surface 51*b* of the first hub 51H. The first shroud 53*a* surrounds the plurality of first blades 51B. The first shroud 53*a* faces the edge surfaces 51Bc of the first blades 51B and forms part of the inner wall surface of the first impeller chamber 28. The pairs of the first blades 51B disposed side by side in the circumferential direction of the first hub 51H, the first hub 51H, and the first shroud 53A form refrigerant flow passages extending radially.

A first tip clearance 61 is formed between the first impeller 51 and the first shroud 53*a*. The first tip clearance 61 is a gap extending between the edge surfaces 51Bc of the first blades 51B and the first shroud 53*a* of the first compressor housing 13 from the leading ends 51Bb to the trailing ends 51Ba of the first blades 51B.

The second compressor housing 14 has a second shroud 53*b* that cooperates with the partition wall 15 to define the second impeller chamber 33. The second shroud 53*b* has a truncated conical shape, which covers the second impeller 52 from an outer side in the radial direction. The second shroud 53*b* faces the outer peripheral surface 52*c* of the second hub 52H. The second shroud 53*b* extends along the outer peripheral surface 52*c* of the second hub 52H from the trailing end surface 52*a* to the leading end surface 52*b* of the second hub 52H. The second shroud 53*b* surrounds the plurality of second blades 52B. The second shroud 53*b* faces the edge surfaces 52Bc of the second blades 52B and forms part of the inner wall surface of the second impeller chamber 33. The pairs of the second blades 52B disposed side by side in the circumferential direction of the second hub 52H, the second hub 52H, and the second shroud 53*b* form refrigerant flow passages extending radially.

A second tip clearance 62 is formed between the second impeller 52 and the second shroud 53*b*. The second tip clearance 62 is a gap extending between the edge surfaces 52Bc of the second blades 52B and the second shroud 53*b* of the second compressor housing 14 from the leading ends 52Bb to the trailing ends 52Ba of the second blades 52B.

Figure 3:
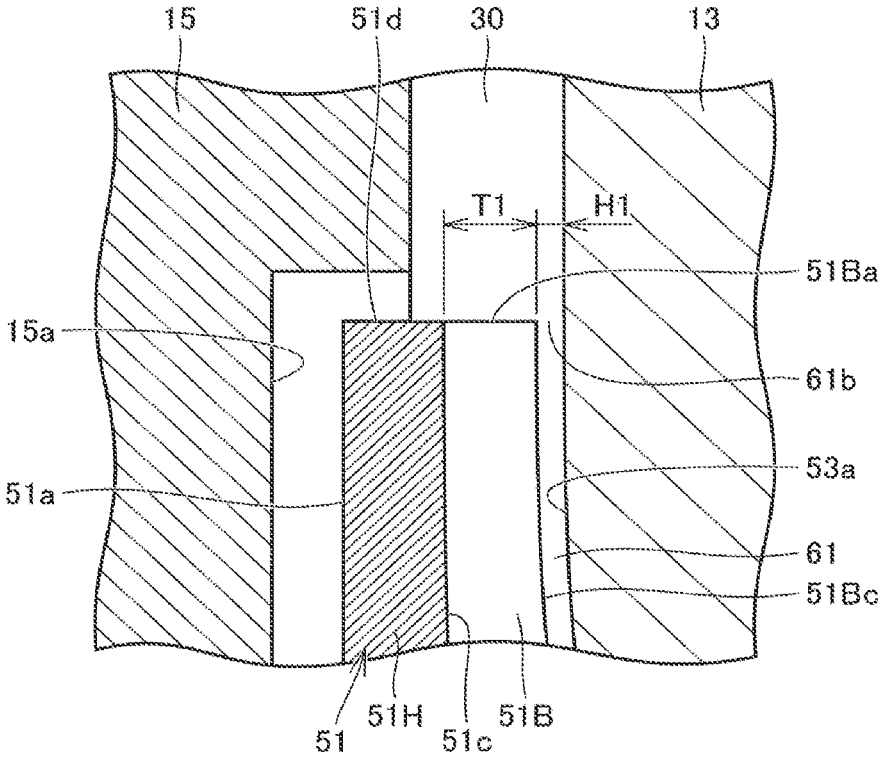
FIG. 3 is an enlarged cross-sectional view illustrating a vicinity of a trailing end of one of first blades.

FIG. 3 is an enlarged cross-sectional view illustrating the vicinity of the trailing end 51Ba of one of the first blades 51B. The first tip clearance 61 includes a first trailing end gap 61*b* that is a gap between the edge surface 51Bc of the trailing end 51Ba of each of the first blades 51B and the first shroud 53*a* in the thrust direction. The first trailing end gap 61*b* is a gap between the trailing end 51Ba of each of the first blades 51B and the first shroud 53*a*, which has the minimum value or the shortest distance between each of the first blades 51B and the first shroud 53*a*. The first trailing end gap 61*b* is a portion having the smallest dimension, of the gap between the edge surface 51Bc of each of the first blades 51B and the first shroud 53*a*.

Figure 4:
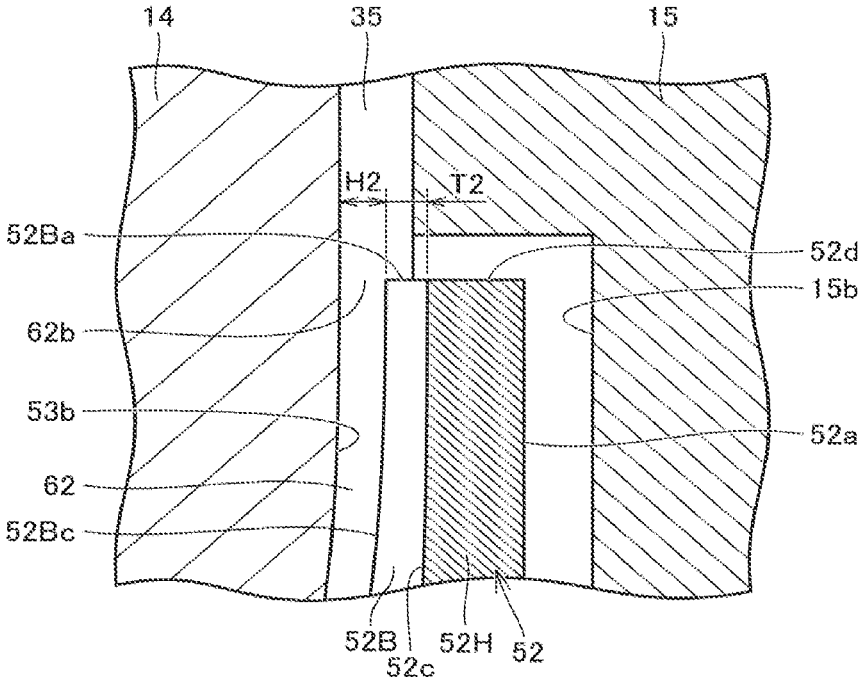
FIG. 4 is an enlarged cross-sectional view illustrating a vicinity of a trailing end of one of second blades.

FIG. 4 is an enlarged cross-sectional view illustrating a vicinity of the trailing end 52Ba of one of the second blades 52B. The second tip clearance 62 includes a second trailing end gap 62*b* that is a gap between the edge surface 52Bc of the trailing end 52Ba of each of the second blades 52B and the second shroud 53*b* in the thrust direction. The second trailing end gap 62*b* is a gap between the trailing end 52Ba of each of the second blades 52B and the second shroud 53*b*, which has the minimum value or the shortest distance between each of the second blades 52B and the second shroud 53*b*. The second trailing end gap 62*b* is a portion having the smallest dimension, of the gap between the edge surface 52Bc of each of the second blades 52B and the second shroud 53*b*.

As illustrated in FIGS. 3 and 4, a length H1, which is a gap dimension of the first trailing end gap 61*b* in the thrust direction, is smaller than a length H2, which is a gap dimension of the second trailing end gap 62*b* in the thrust direction. The shortest distance between the edge surface 51Bc of each of the first blades 51B and the first shroud 53*a* of the first compressor housing 13 at the trailing end 51Ba of each of the first blades 51B is smaller than the shortest distance between the edge surface 52Bc of each of the second blades 52B and the second shroud 53*b* of the second compressor housing 14 at the trailing end 52Ba of each of the second blades 52B.

Figure 5:
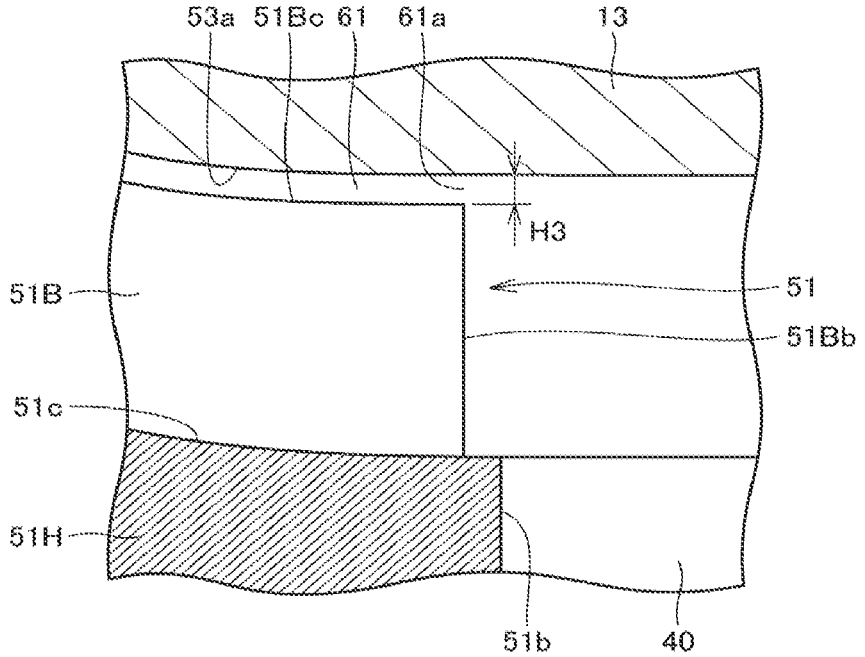
FIG. 5 is an enlarged cross-sectional view illustrating a vicinity of a leading end of one of the first blades.

FIG. 5 is an enlarged cross-sectional view illustrating a vicinity of the leading end 51Bb of one of the first blades 51B. The first tip clearance 61 includes a first leading end gap 61*a* that is a gap between the edge surface 51Bc of the leading end 51Bb of each of the first blades 51B and the first shroud 53*a* in the radial direction. The first leading end gap 61*a* is a gap between the leading end 51Bb of each of the first blades 51B and the first shroud 53*a*, which has the minimum value or the shortest distance between each of the first blades 51B and the first shroud 53*a*. The first leading end gap 61*a* is a portion having the smallest dimension, of the gap between the edge surface 51Bc of each of the first blades 51B and the first shroud 53*a*.

Figure 6:
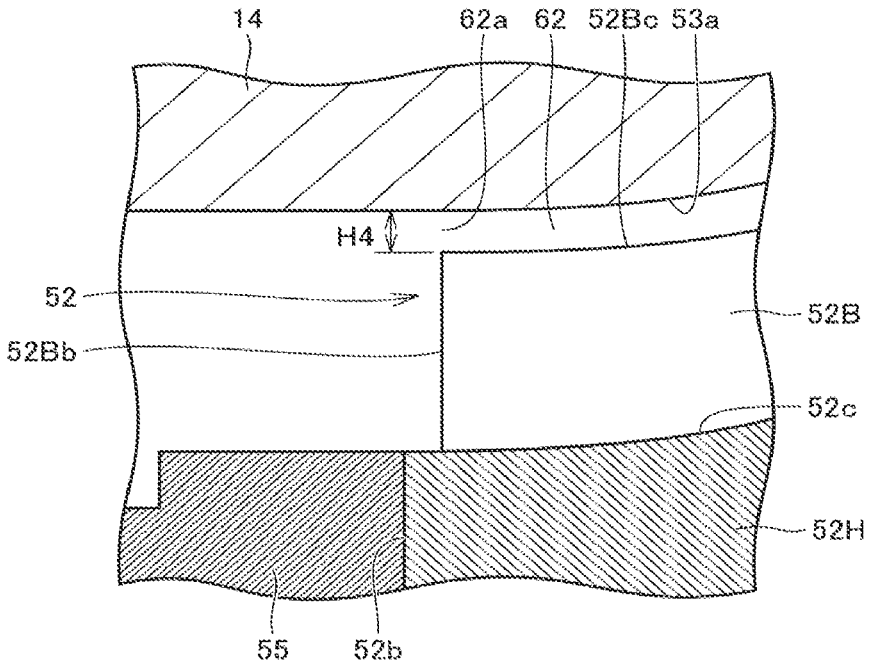
FIG. 6 is an enlarged cross-sectional view illustrating a vicinity of a leading end of one of the second blades.

FIG. 6 is an enlarged cross-sectional view illustrating a vicinity of the leading end 52Bb of one of the second blades 52B. The second tip clearance 62 includes a second leading end gap 62*a* that is a gap between the edge surface 52Bc of the leading end 52Bb of each of the second blades 52B and the second shroud 53*b* in the radial direction. The second leading end gap 62*a* is a gap between the leading end 52Bb of each of the second blades 52B and the second shroud 53*b*, which has the minimum value or the shortest distance between each of the second blades 52B and the second shroud 53*b*. The second leading end gap 62*a* is a portion having the smallest dimension, of the gap between the edge surface 52Bc of each of the second blades 52B and the second shroud 53*b*.

As illustrated in FIGS. 5 and 6, a length H3, which is a gap dimension of the first leading end gap 61*a* in the radial direction, is smaller than a length H4, which is a gap dimension of the second leading end gap 62*a* in the radial direction. The shortest distance between the edge surface 51Bc of each of the first blades 51B and the first shroud 53*a* of the first compressor housing 13 at the leading end 51Bb of each of the first blades 51B is smaller than the shortest distance between the edge surface 52Bc of each of the second blades 52B and the second shroud 53*b* of the second compressor housing 14 at the leading end 52Bb of each of the second blades 52B.

In addition, as illustrated in FIGS. 3 and 4, a first outlet height T1, which is a dimension of each of the first blades 51B in the axial direction thereof at the trailing end 51Ba of each of the first blades 51B of the first impeller 51, is greater than a second outlet height T2, which is a dimension of each of the second blades 52B in the axial direction thereof at the trailing end 52Ba of each of the second blades 52B of the second impeller 52. Thus, an outlet blade height of the first impeller 51 is greater than an outlet blade height of the second impeller 52.

The first outlet height T1 is a height of the trailing end 51Ba of each of the first blades 51B toward the first trailing end gap 61*b*. The first outlet height T1 is the height of the trailing end 51Ba of each of the first blades 51B that protrudes from the outer peripheral surface 51*c* of the first hub 51H toward the first trailing end gap 61*b*, and refers to the largest protruding height in each of the first blades 51B. The second outlet height T2 is a height of the trailing end 52Ba of each of the second blades 52B toward the second trailing end gap 62*b*. The second outlet height T2 is the height of the trailing end 52Ba of each of the second blades 52B that protrudes from the outer peripheral surface 52*c* of the second hub 52H toward the second trailing end gap 62*b*, and refers to the largest protruding height in each of the second blades 52B.

In the electric turbo compressor 1, refrigerant is drawn into the motor chamber 18 through an inlet hole (not illustrated). The refrigerant drawn into the motor chamber 18 passes through the communication holes 23, the thrust bearing accommodation chamber 25, the communication holes 16*b*, and the inside of the second chamber forming recess 16*c*, and is drawn into the first inlet 24. The refrigerant drawn into the first inlet 24 is pressurized by the centrifugal action of the first impeller 51, and is fed from the first impeller chamber 28 into the first diffuser passage 30 in which the refrigerant is further pressurized. The refrigerant having passed through the first diffuser passage 30 is discharged to the first discharge chamber 29.

The refrigerant discharged to the first discharge chamber 29 passes through the intermediate pressure chamber 31, and is drawn into the second inlet 32. The refrigerant drawn into the second inlet 32 is pressurized by the centrifugal action of the second impeller 52, and is fed from the second impeller chamber 33 into the second diffuser passage 35 in which the refrigerant is further pressurized. The refrigerant having passed through the second diffuser passage 35 is discharged to the second discharge chamber 34. The second discharge chamber 34 is in communication with a discharge port (not illustrated). The refrigerant compressed by the electric turbo compressor 1 is discharged from the discharge port to an outside of the electric turbo compressor 1.

As has been described, in the electric turbo compressor 1 of the embodiment, as illustrated in FIGS. 3 and 4, the first trailing end gap 61*b*, which is the gap between the trailing end 51Ba of each of the first blades 51B and the first shroud 53*a* and is the smallest gap between each of the first blades 51B and the first shroud 53*a*, is formed smaller than the second trailing end gap 62*b*, which is the gap between the trailing end 52Ba of each of the second blades 52B and the second shroud 53*b* and is the smallest gap between each of the second blades and the second shroud 53*b*.

The second impeller 52 compresses the refrigerant having been compressed by the first impeller 51. The pressure of the refrigerant flowing through the second impeller chamber 33 is higher than the pressure of the refrigerant flowing through the first impeller chamber 28. Since the density of the refrigerant flowing through the first impeller chamber 28 is lower than the density of the refrigerant flowing through the second impeller chamber 33, a volumetric flow rate needs to be higher in the first impeller 51. Thus, the flow velocity of the refrigerant flowing through the first impeller chamber 28 is higher than the flow velocity of the refrigerant flowing through the second impeller chamber 33. It is noted that the compression ratio of the refrigerant by the first impeller 51 is higher than that by the second impeller 52.

As the flow velocity of the refrigerant increases, an effect of the tip clearance becomes greater. In the first impeller 51 where the flow velocity of the refrigerant is high, the flow of the refrigerant is disturbed if the first tip clearance 61 is large. In the second impeller 52 where the flow velocity of the refrigerant is low, an effect on the performance is small even if the second tip clearance 62 is large. Disturbance in the flow of the refrigerant may be suppressed by making the tip clearance of the first impeller 51 small to set the first trailing end gap 61*b* smaller than the second trailing end gap 62*b*. Therefore, the electric turbo compressor 1 of the embodiment may perform efficient two-stage compression.

The second impeller 52 is disposed closer to the first end 40*a* of the rotary shaft 40 than the first impeller 51 is. The second impeller 52 disposed on the tip end side of the rotary shaft 40 may have greater runout than the first impeller 51 during operation. By setting the second trailing end gap 62*b* larger than the first trailing end gap 61*b*, contact between the second impeller 52 and the second compressor housing 14 may be suppressed. Therefore, the reliability of the electric turbo compressor 1 may be improved.

As illustrated in FIGS. 3 and 4, the first outlet height T1 which is a protruding height of the trailing end 51Ba of each of the first blades 51B from the outer peripheral surface 51*c* of the first hub 51H to the first trailing end gap 61*b* is greater than the second outlet height T2 which is a protruding height of the trailing end 52Ba of each of the second blades 52B from the outer peripheral surface 52*c* of the second hub 52H to the second trailing end gap 62*b*.

Since both the first impeller 51 and the second impeller 52 rotate integrally with the rotating shaft 40, the rotation speeds of the first impeller 51 and the second impeller 52 are equal to each other. In this case, the compression efficiency of the first impeller 51 may be improved by making the first outlet height T1 larger than the second outlet height T2. By increasing the pressure of the refrigerant discharged from the first impeller 51, the flow velocity of the refrigerant flowing into the second impeller 52 may be reduced. Thus, the effect on performance may be reduced even if the second tip clearance 62 is increased. As a result, an effect of the configuration in which the first trailing end gap 61*b* is made smaller than the second trailing end gap 62*b* to achieve the efficient two-stage compression may be more reliably obtained.

As illustrated in FIG. 2, the outer diameter R1 of the first impeller 51 is greater than the outer diameter R2 of the second impeller 52. With this configuration, the compression efficiency of the first impeller 51 is increased and the pressure of the refrigerant discharged from the first impeller 51 is increased, so that the flow velocity of the refrigerant flowing into the second impeller 52 may be further reduced. Thus, the effect on performance may be reduced even if the second tip clearance 62 is increased. As a result, the effect of the configuration in which the first trailing end gap 61*b* is made smaller than the second trailing end gap 62*b* to achieve the efficient two-stage compression may be more reliably obtained.

As illustrated in FIGS. 5 and 6, the first leading end gap 61*a*, which is the gap between the leading end 51Bb of each of the first blades 51B and the first shroud 53*a* and is the smallest gap between each of the first blades 51B and the first shroud 53*a*, is smaller than the second leading end gap 62*a*, which is the gap between the leading end 52Bb of each of the second blades 52B and the second shroud 53*b* and is the smallest gap between each of the second blades 52B and the second shroud 53*b*. Disturbance in the flow of the refrigerant may be suppressed by making the tip clearance of the first impeller 51 small to set the first leading end gap 61*a* smaller than the second leading end gap 62*a*. As a result, the efficient two-stage compression can be performed. Furthermore, since contact between the second impeller 52 and the second compressor housing 14 may be suppressed, the reliability may be improved.

Since fluid to be compressed by the electric turbo compressor 1 is a refrigerant that circulates in the refrigeration cycle, even if the second tip clearance 62 is increased, the effect on performance may be reduced. Thus, the efficient and reliable two-stage compression may be achieved by making the first trailing end gap 61*b* smaller than the second trailing end gap 62*b*.

Figure 7:
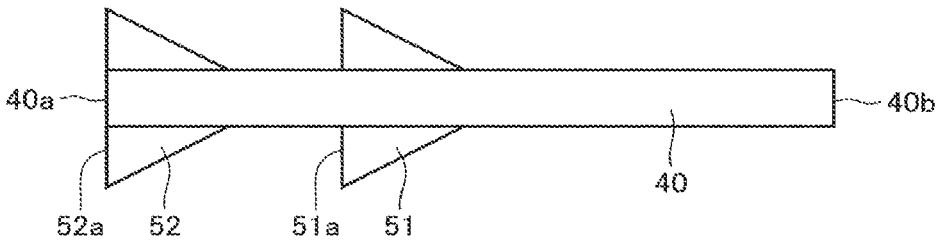
FIG. 7 is a schematic view schematically illustrating a modified example of an arrangement of impellers.

In the description of the embodiment, an example of an arrangement in which the trailing end surface 51*a* of the first hub 51H of the first impeller 51 and the trailing end surface 52*a* of the second hub 52H of the second impeller 52 face each other with the partition wall 15 interposed therebetween has been described. The arrangement of the first impeller 51 and the second impeller 52 is not limited to this example. FIG. 7 is a schematic view schematically illustrating a modified example of an arrangement of the impellers. As illustrated in FIG. 7, the first impeller 51 and the second impeller 52 may be arranged so that the leading end surfaces 51*b*, 52*b* face the second end 40*b* of the rotary shaft 40 and the trailing end surfaces 51*a*, 52*a* face the first end 40*a* of the rotary shaft 40. Even in this case, by arranging the second impeller 52 closer to the first end 40*a* of the rotary shaft 40 and setting the first trailing end gap 61*b* smaller than the second trailing end gap 62*b*, efficient and reliable two-stage compression may be achieved.

Although the electric turbo compressor 1 described in the embodiment is a centrifugal compressor, the technical idea of the present disclosure is also applicable to a diagonal flow type compressor.

Although the description of the embodiment has been provided as above, the embodiment disclosed herein is an example in all respects, and should not be considered restrictive. The scope of the present disclosure shall be defined not by the description but by the claims, and is intended to include embodiments equivalent to the scope of the claims and all modifications within the scope.

REFERENCE SIGNS LIST

1 electric turbo compressor
10 housing
11 rear housing
13 first compressor housing
second compressor housing 14
15 partition wall
15*a* first facing surface
15*b* second facing surface
24 first inlet
27 through hole
28 first impeller chamber
29 first discharge chamber
30 first diffuser passage
31 intermediate pressure chamber

32 second inlet
33 second impeller chamber
34 second discharge chamber
35 second diffuser passage
40 rotary shaft
40*a* first end
40*b* second end
41 electric motor
51 first impeller
51B first blade
51Ba, 52Ba trailing end
51Bb, 52Bb leading end
51Bc, 52Bc, edge surface
51H first hub
51*a*, 52*a* trailing end surface
51*b*, 52*b* leading end surface
51*c*, 52*c* outer peripheral surface
51*d*, 52*d* radial outer edge portion
52 second impeller
52B second blade
52H second hub
53*a* first shroud
53*b* second shroud
54 spacer
55 fitting member
61 first tip clearance
61*a* first leading end gap
61*b* first trailing end gap
62 second tip clearance
62*a* second leading end gap
62*b* second trailing end gap
H1, H2, H3, H4 length
L axis
R1, R2 outer diameter

The invention claimed is:

1. An electric turbo compressor comprising:

a housing;

an electric motor accommodated in the housing;

a rotary shaft accommodated in the housing, and driven to rotate by the electric motor; and a first impeller and a second impeller rotating together with the rotary shaft, wherein the electric motor, the first impeller, and the second impeller are arranged in this order in an axial direction of the rotary shaft, the first impeller includes a first hub fixed to the rotary shaft, and a plurality of first blades arranged on the first hub, the second impeller includes a second hub fixed to the rotary shaft, and a plurality of second blades arranged on the second hub, the first impeller rotates to move gas from a first leading end to a first trailing end of each of the plurality of first blades, wherein the first trailing end is a first edge portion of each of the plurality of first blades, and the first edge portion extends in the axial direction of the rotary shaft, the second impeller rotates to move the gas moved by the first impeller from a second leading end to a second trailing end of each of the plurality of second blades, wherein the second trailing end is a second edge portion of each of the plurality of second blades, and the second edge portion extends in the axial direction of the rotary shaft, the housing includes:

a first shroud facing the first blades and forming a first impeller chamber that accommodates the first impeller; and a second shroud facing the second blades and forming a second impeller chamber that accommodates the second impeller, a gap between the first edge portion of each of the first blades and the first shroud is a first trailing end gap that has a shortest distance between each of the first blades and the first shroud in the axial direction, and a gap between the second edge portion of each of the second blades and the second shroud is a second trailing end gap that has a shortest distance between each of the second blades and the second shroud in the axial direction, and the first edge portion faces a first diffuser passage that is a first outlet of the first impeller chamber and downstream of the first trailing end of the first blades in a radial direction of a gas movement, the second edge portion faces a second diffuser passage that is a second outlet of the second impeller chamber and downstream of the second trailing end of the second blades in the radial direction of the gas movement, and the shortest distance of the first trailing end gap is smaller than the shortest distance of the second trailing end gap.

2. The electric turbo compressor according to claim 1, wherein a height of the trailing end of each of the first blades toward the first trailing end gap is a first outlet height, and a height of the second trailing end of each of the second blades is a second outlet height, and the first outlet height is greater than the second outlet height.

3. The electric turbo compressor according to claim 1, wherein an outer diameter of the first impeller is greater than an outer diameter of the second impeller.

4. The electric turbo compressor according to claim 1, wherein a gap between the first leading end of each of the first blades and the first shroud is a first leading end gap that has a shortest distance between each of the first blades and the first shroud, and a gap between the second leading end of each of the second blades and the second shroud is a second leading end gap that has a shortest distance between each of the second blades and the second shroud, and the first leading end gap is smaller than the second leading end gap.

5. The electric turbo compressor according to claim 1, wherein the electric turbo compressor is configured to compress refrigerant circulating in a refrigeration cycle.

* * * * *